US009156272B2

(12) United States Patent
Tamada et al.

(10) Patent No.: US 9,156,272 B2
(45) Date of Patent: Oct. 13, 2015

(54) LIQUID SUPPLY APPARATUS FOR AVOIDING ERRONEOUS INSTALLATION OF LIQUID CARTRIDGE, PRINTER PROVIDED WITH THE SAME AND LIQUID CARTRIDGE FOR THE SAME

(75) Inventors: Hisashi Tamada, Nagoya (JP); Keiji Kura, Nagoya (JP); Yusuke Suzuki, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 388 days.

(21) Appl. No.: 12/952,721

(22) Filed: Nov. 23, 2010

(65) Prior Publication Data

US 2011/0157274 A1 Jun. 30, 2011

(30) Foreign Application Priority Data

Dec. 25, 2009 (JP) ..... 2009-293983

(51) Int. Cl.
*B41J 2/015* (2006.01)
*B41J 2/175* (2006.01)

(52) U.S. Cl.
CPC ..... *B41J 2/17509* (2013.01); *B41J 2/1752* (2013.01); *B41J 2/17513* (2013.01); *B41J 2/17523* (2013.01)

(58) Field of Classification Search
None
See application file for complete search history.

(56) References Cited

U.S. PATENT DOCUMENTS

| | | | | |
|---|---|---|---|---|
| 5,943,078 | A * | 8/1999 | Nishimoto et al. | 347/89 |
| 6,065,828 | A * | 5/2000 | Lo et al. | 347/85 |
| 6,238,042 | B1 | 5/2001 | Kobayashi et al. | |
| 2004/0056918 | A1 * | 3/2004 | Wang et al. | 347/21 |
| 2005/0146577 | A1 | 7/2005 | Sasaki et al. | |
| 2006/0238581 | A1 | 10/2006 | Yoshimura et al. | |
| 2007/0171263 | A1 * | 7/2007 | Inoue et al. | 347/74 |
| 2008/0291252 | A1 * | 11/2008 | Sakai et al. | 347/86 |

FOREIGN PATENT DOCUMENTS

| | | | | |
|---|---|---|---|---|
| JP | 11-342625 | | 12/1999 | |
| JP | 11342625 | A * | 12/1999 | B41J 2/175 |
| JP | 2001096759 | A * | 4/2001 | B41J 2/175 |
| JP | 2001138542 | A * | 5/2001 | B41J 2/175 |

(Continued)

OTHER PUBLICATIONS

Notice of Reasons for Rejection dated Dec. 25, 2012 received from the Japanese Patent Office from related Japanese Application No. 2009-293983, together with an English-language translation.

(Continued)

*Primary Examiner* — Geoffrey Mruk
*Assistant Examiner* — Bradley Thies
(74) *Attorney, Agent, or Firm* — Scully, Scott, Murphy & Presser P.C.

(57) ABSTRACT

A liquid supply apparatus, which supplies a liquid or liquids stored in liquid cartridges of a plurality of types, includes a plurality of cartridge installing sections to which the liquid cartridges of the plurality of types are detachably installable, wherein a plurality of connection ports, which correspond to supply ports formed for the liquid cartridges of the plurality of types respectively, are formed at mutually different positions of the respective cartridge installing sections.

13 Claims, 13 Drawing Sheets

(56) References Cited

FOREIGN PATENT DOCUMENTS

| | | | | |
|---|---|---|---|---|
| JP | 2003-54007 | | | 2/2003 |
| JP | 2004255890 | A | | 9/2004 |
| JP | 200547057 | A | | 2/2005 |
| JP | 2005238473 | A | | 9/2005 |
| JP | 2006-110918 | | | 4/2006 |
| JP | 2006110918 | A | * | 4/2006 |
| JP | 2008-183746 | | | 8/2008 |
| JP | 2008183746 | A | * | 8/2008 |

OTHER PUBLICATIONS

Notice of Reasons for Rejection dated Sep. 3, 2013 from Japanese Patent Application No. 2013-034276, together with an English language translation.

Partial English Translation of Japanese Patent Application Laid-open No. 2006-110918.

Notice of Decision of Refusal dated Nov. 26, 2013 in counterpart Japanese Patent Application No. 2013-034276.

* cited by examiner

LIQUID SUPPLY APPARATUS FOR AVOIDING ERRONEOUS INSTALLATION OF LIQUID CARTRIDGE, PRINTER PROVIDED WITH THE SAME AND LIQUID CARTRIDGE FOR THE SAME

CROSS REFERENCE TO RELATED APPLICATION

The present application claims priority from Japanese Patent Application No. 2009-293983, filed on Dec. 25, 2009, the disclosure of which is incorporated herein by reference in its entirety.

BACKGROUND OF THE INVENTION

1. Field of the Invention

The present invention relates to a liquid supply apparatus for supplying a liquid or liquids, and a printer.

2. Description of the Related Art

A liquid supply apparatus has been hitherto widely known in various technical field, the liquid supply apparatus including a plurality of cartridge installing sections to which liquid cartridges of a plurality of kinds of liquids are installable respectively, wherein liquids are supplied to a variety of objectives from the liquid cartridges installed to the cartridge installing sections. For example, in a liquid supply apparatus described in Japanese Patent Application Laid-open No. 2003-54007, one connection port is provided for each of a plurality of cartridge installing sections, and installation positions of liquid cartridges of a plurality of types are determined previously. Further, the liquid cartridges of the plurality of types have the same positions of supply ports. In the case of such an arrangement, it is feared that any erroneous installation may be caused. Therefore, it is necessary to provide any artifice in order to avoid the erroneous installation. In the liquid supply apparatus, engagement guide sections, which have different shapes depending on the types of the liquid cartridges, are formed respectively on surfaces of the plurality of types of the liquid cartridges, the surfaces being to be opposed to the cartridge installing sections upon the installation. Further, engagement receiving sections, which has shapes corresponding to the engagement guide sections of the plurality of types of the liquid cartridges, are formed respectively for the plurality of cartridge installing sections. Each of the cartridge installing sections is constructed so that only a specified liquid cartridge, in which a specified engagement guide section corresponding to the engagement receiving section formed for the specified cartridge installing section, can be installed. In this way, the erroneous installation is avoided.

However, in the case of the liquid supply apparatus described in Japanese Patent Application Laid-open No. 2003-54007, it is necessary that the installation position for the intended liquid cartridge should be confirmed with respect to the plurality of cartridge installing sections. A user undergoes the troublesome installation operation. Further, a structure for avoiding the erroneous installation of the cartridge installing sections and the liquid cartridges are complicated.

SUMMARY OF THE INVENTION

In view of the above, an object of the present invention is to provide a liquid supply apparatus in which the installation operation is convenient for a user while simplifying the arrangement or structure of liquid cartridges and cartridge installing sections, and to provide a printer which is based on the use of such a liquid supply apparatus.

According to a first aspect of the present invention, there is provided a liquid supply apparatus which supplies a plurality of kinds of liquids stored in a plurality of types of liquid cartridges each having a supply port, respectively, the liquid supply apparatus comprising:

a plurality of cartridge installing sections to which the liquid cartridges are detachably installable, each of the cartridge installing sections including a plurality of connection ports, each of which corresponds to the supply port formed for one of the liquid cartridges, and which are formed at mutually different positions of the respective cartridge installing sections.

According to the liquid supply apparatus of the present invention, the plurality of connection ports, each of which corresponds to the supply port of one of the liquid cartridges of the plurality of types, are formed for the respective cartridge installing sections. Therefore, even when the liquid cartridges of the plurality of types are installed at any position of the plurality of cartridge installing sections, then the supply port of the liquid cartridge is communicated with the connection port corresponding to the type of the liquid cartridge, and the liquid or liquids can be supplied to the supply flow passages. In this way, any installation position is available for the liquid cartridges of the plurality of types without any problem, and the installation operation is conveniently performed by a user. Further, it is unnecessary to provide any arrangement or structure for avoiding the erroneous installation for the liquid cartridge and/or the cartridge installing section. It is possible to simplify the arrangement or structure of the liquid cartridge and the cartridge installing section.

According to a second aspect of the present invention, there is provided a printer which performs printing on a medium with a plurality of inks stored in a plurality of types of ink cartridges each having a supply port, the printer comprising:

a liquid supply mechanism including a plurality of cartridge installing sections to which the ink cartridges are detachably installable, each of the cartridge installing sections having a plurality of connection ports each of which corresponds to the supply port formed for one of the ink cartridges and which are formed at mutually different positions of the respective cartridge installing sections;

a head which performs the printing by discharging liquid droplets of the inks onto the medium;

a moving section which moves the medium relative to the head; and supply flow passages through which the liquid supply mechanism and the head are liquid-communicated, and through which the inks are supplied to the head.

The plurality of connection ports, which correspond to the supply ports of the ink cartridges of the plurality of types respectively, are formed for the respective cartridge installing sections. Therefore, any installation position is available for the ink cartridges of the plurality of types without any problem, and the installation operation is conveniently performed by a user. Owing to the fact that any installation position is available without any problem, it is unnecessary to provide any arrangement or structure for avoiding the erroneous installation for the ink cartridge and/or the cartridge installing section. It is possible to simplify the arrangement or structure of the ink cartridge and the cartridge installing section.

DESCRIPTION OF THE PREFERRED EMBODIMENTS

Next, an embodiment of the present teaching will be explained. In this embodiment, the present teaching is applied to a printer which records or prints, for example, desired letters and images on the recording paper by jetting an ink or inks from an ink-jet head to the recording paper.

Figure 1:
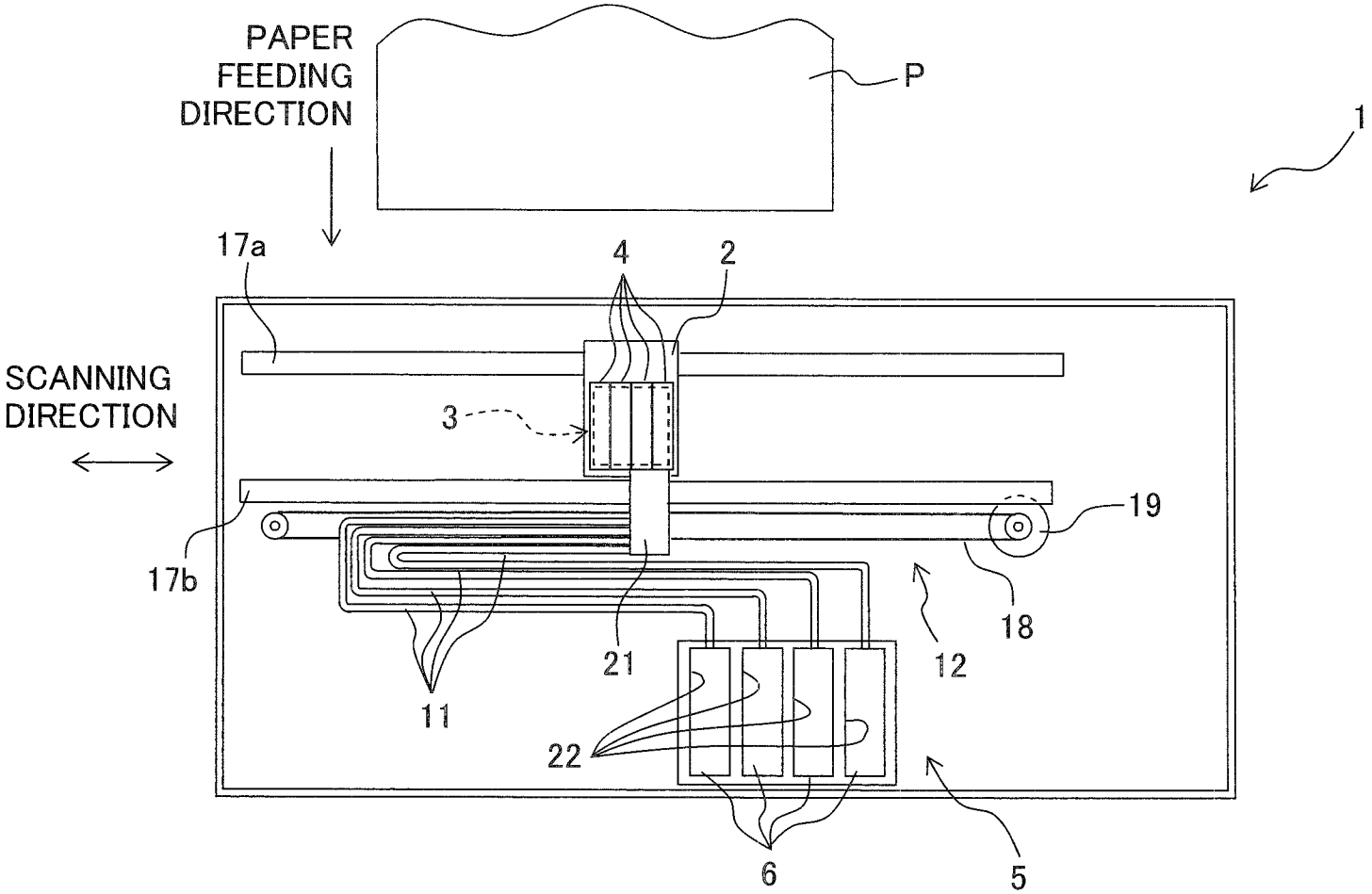
FIG. 1 shows a schematic plan view illustrating an ink-jet printer according to an embodiment of the present invention.

At first, an explanation will be made with reference to FIG. 1 about a schematic arrangement of the printer 1. As shown in FIG. 1, the printer 1 includes, for example, a carriage 2 which is constructed reciprocatively movably in one direction, an ink-jet head 3 and subtanks 4 which are carried on the carriage 2, and an ink supply apparatus 5 (liquid supply apparatus) to which ink cartridges 6 (liquid cartridges) for storing the ink or inks are detachably installable.

The printer 1 is provided with two guide frames 17*a*, 17*b* which extend in parallel in one horizontal direction (left-right direction as shown in FIG. 1: scanning direction) and which are arranged while providing a spacing distance in a paper feeding direction perpendicular to the scanning direction. The carriage 2 is attached to the two guide frames 17*a*, 17*b*. The carriage 2 is reciprocatively driven by a carriage driving mechanism 12 while being guided by the two guide frames 17*a*, 17*b*. The carriage driving mechanism 12 includes an endless belt 18 which is connected to the carriage 2, and a carriage driving motor 19 which allows the endless belt 18 to travel. When the endless belt 18 is driven to travel by the carriage driving motor 19, the carriage 2 is reciprocatively moved in the scanning direction in accordance with the travel of the endless belt 18.

The ink-jet head 3 and the four subtanks 4 are carried on the carriage 2. The four subtanks 4 correspond to four color inks of black, yellow, cyan, and magenta respectively, and they are arranged side by side in the scanning direction. The ink-jet head 3 is provided under or below the four subtanks 4. The respective subtanks 4 temporarily store the inks supplied from the ink cartridges 6. A tube joint 21 is integrally provided at first ends of the four subtanks 4. The four subtanks 4 are connected to the ink supply apparatus 5 via four flexible tubes 11 connected to the tube joint 21 respectively. On the other hand, second ends of the four subtanks 4 are connected to ink supply ports (not shown) provided on the upper surface of the ink-jet head 3. Accordingly, the inks, which are supplied via the tubes 11 from the ink cartridges 6 installed to the ink supply apparatus 5, are temporarily stored in the subtanks 4, and the inks contained in the subtanks 4 are supplied to the ink jet head 3.

A plurality of unillustrated nozzles are formed on the lower surface of the ink-jet head 3. The inks, which are supplied from the subtanks 4, are jetted by the ink-jet head 3 from the plurality of nozzles respectively toward the recording paper P transported in the paper feeding direction (see FIG. 1) by means of an unillustrated transport mechanism, while the ink-jet head 3 is reciprocatively moved in the scanning direction together with the carriage 2. Accordingly, for example, desired letters and images are recorded on the recording paper P.

The ink supply apparatus 5 includes a holder 10 which has four cartridge installing sections 22 for detachably installing the four ink cartridges 6 for storing the four color inks of black, yellow, cyan, and magenta respectively.

The ink supply apparatus 5 will be explained in detail with reference to FIGS. 2 to 5. As shown in FIGS. 2 to 5, the holder 10 of the ink supply apparatus 5 has a rectangular parallelepiped-shaped bottom wall 10*a* through which the inks contained in the installed ink cartridges 6 are supplied to the subtanks 4 via the tubes 11, and two side walls 10*b* which are extended upwardly in the vertical direction from both end portions of the bottom wall 10*a* in the X direction (paper feeding direction). The bottom wall 10*a* and the two side walls 10*b* constitute the four cartridge installing sections 22 which are aligned in the Y direction (scanning direction) and to which the four ink cartridges 6 can be installed.

The bottom wall 10*a* has a plurality of cylindrical members 23 which protrude upwardly in the vertical direction from the upper surface, and four supply flow passages 26 (26*a* to 26*d*) which are formed in the cylindrical member 23.

The cylindrical member 23 is a hollow member, and a hollow internal space formed in the cylindrical member 23 functions as the flow passage. The forward end of the cylindrical member 23 is open upwardly in the vertical direction to serve as a connection port 25 (25*a* to 25*d*) which is connectable to a supply port 38*a* of the ink cartridge 6 as described later on. The connection ports 25*a* to 25*d* are arranged in this order from top down as viewed in FIG. 3. In the following description, when the respective connection ports 25*a* to 25*d* and the respective supply flow passages 26*a* to 26*d* are not distinguished from each other, they are simply referred to as "connection ports 25" and "supply flow passages 26". In this arrangement, the arrays of the cylindrical members 23 are arranged and aligned in four arrays in the Y direction. The four cylindrical members 23, which are aligned in the X direction, are included in each of the arrays. In this embodiment, the different kinds of inks having different colors are supplied to the connection ports 25*a* to 25*d* of the plurality of cylindrical members 23 depending on the positions in relation to the X direction. In other words, the four arrays of the connection ports 25, in each of which the four connection ports 25*a* to 25*d* are aligned in the X direction, are aligned in the Y direction on the bottom wall 10*a*. The four connection ports 25*a* to 25*d*, which are aligned in the X direction, correspond to one cartridge installing section 22. The four arrays of the connection ports 25, in each of which the four connection ports 25*a* to 25*d* are aligned in the X direction, are aligned in the Y direction to correspond to the four cartridge installing sections 22 which are aligned in the Y direction. In this way, the four connection ports 25*a* to 25*d* are arranged for each of the cartridge installing sections 22. Further, the four cartridge installing sections 22 are constructed in a compact manner in which the plurality of connection ports 25*a* to 25*d* are arranged in a matrix form.

The supply flow passages 26*a* to 26*d* extend in the Y direction respectively, and they are connected to the tubes 11. In this embodiment, the supply flow passages 26*a* to 26*d* are arranged in this order from top down as viewed in FIG. 3. Each of the supply flow passages 26*a* to 26*d* is communicated with four flow passages, which are aligned in the Y direction and to which the ink of the same kind is supplied, in the bottom wall 10*a*. In other words, each of the supply flow passages 26*a* to 26*d* is connected to the four flow passages disposed in the four cylindrical members 23 aligned in the Y direction. In this case, these four flow cylindrical members 23, which are aligned in the Y direction and connected to one of the supply flow passages 26*a* to 26*d*, constitute a set of the cylindrical members 23. The four sets of the cylindrical members 23, each of which includes the four cylindrical members 23, are arranged at the same positions in the X direction The four supply flow passages 26*a* to 26*d* are arranged and aligned in the X direction. The features described above are summarized as follows. That is, the four supply flow passages 26*a* to 26*d* respectively have the same positions in the X direction as those of the cylindrical members 23 corresponding to the four types of the connection ports 25*a* to 25*d* respectively, and the four supply flow passages 26*a* to 26*d* are connected to the four tubes 11 respectively.

Figure 2:
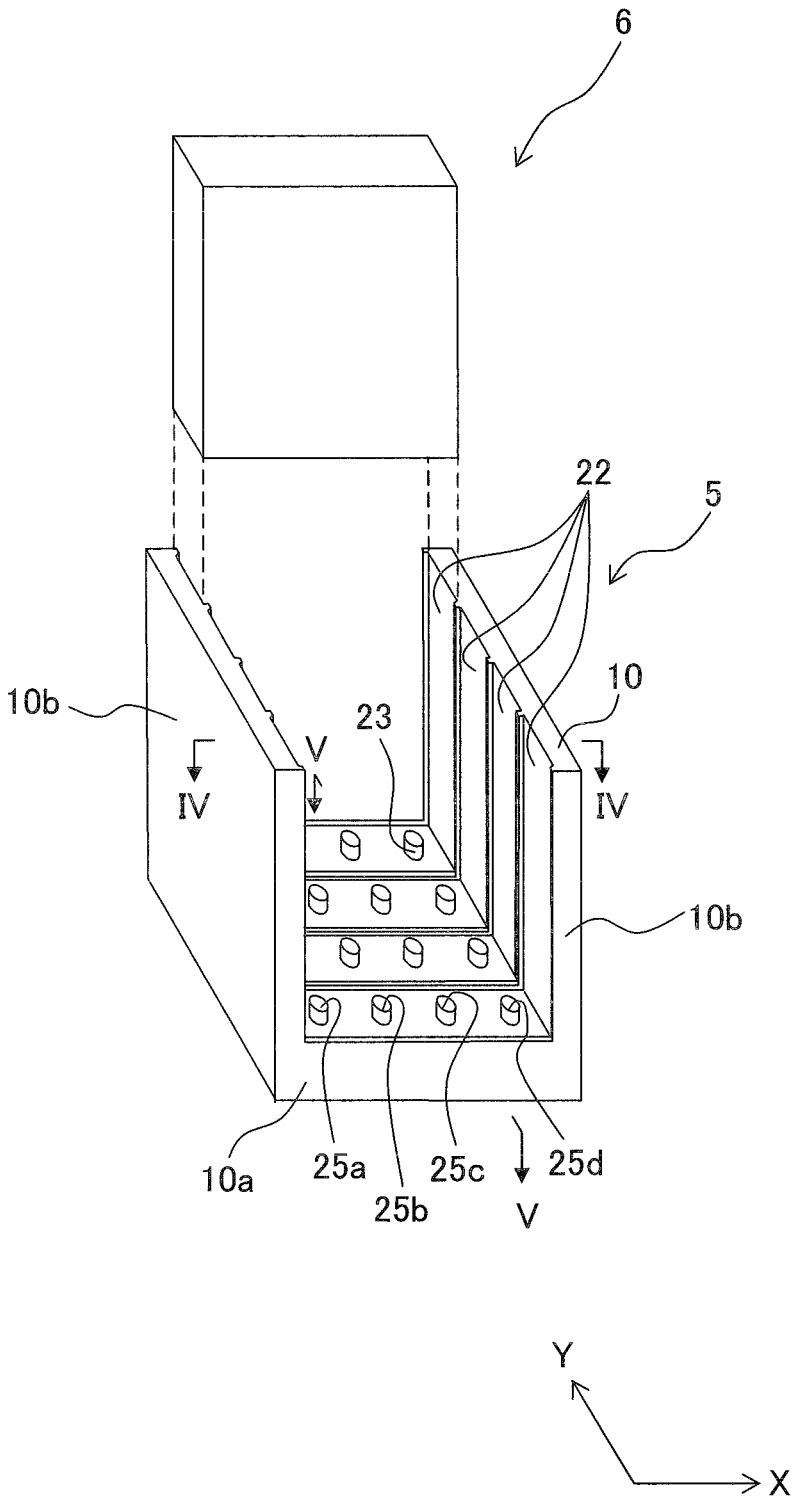
FIG. 2 shows a schematic perspective view illustrating an ink supply apparatus.
Figure 3:
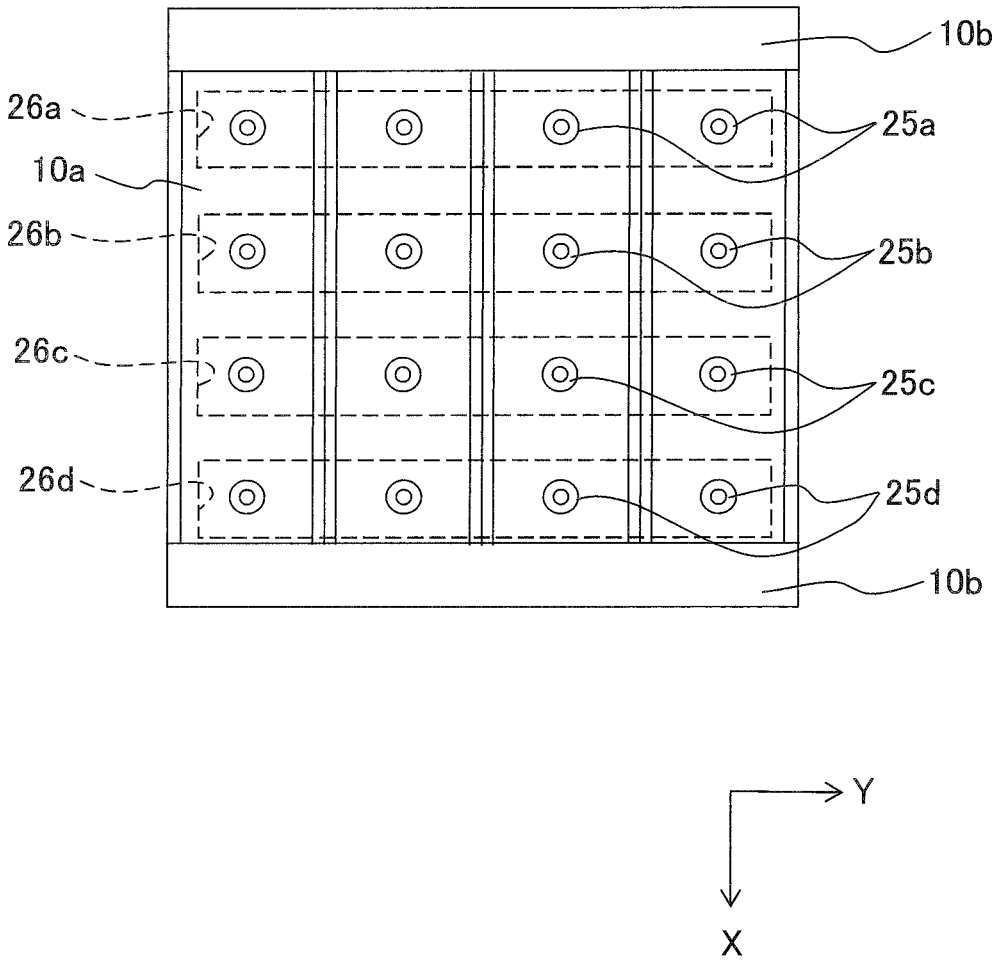
FIG. 3 shows a plan view illustrating the ink supply apparatus as viewed from an upper position.
Figure 4A:
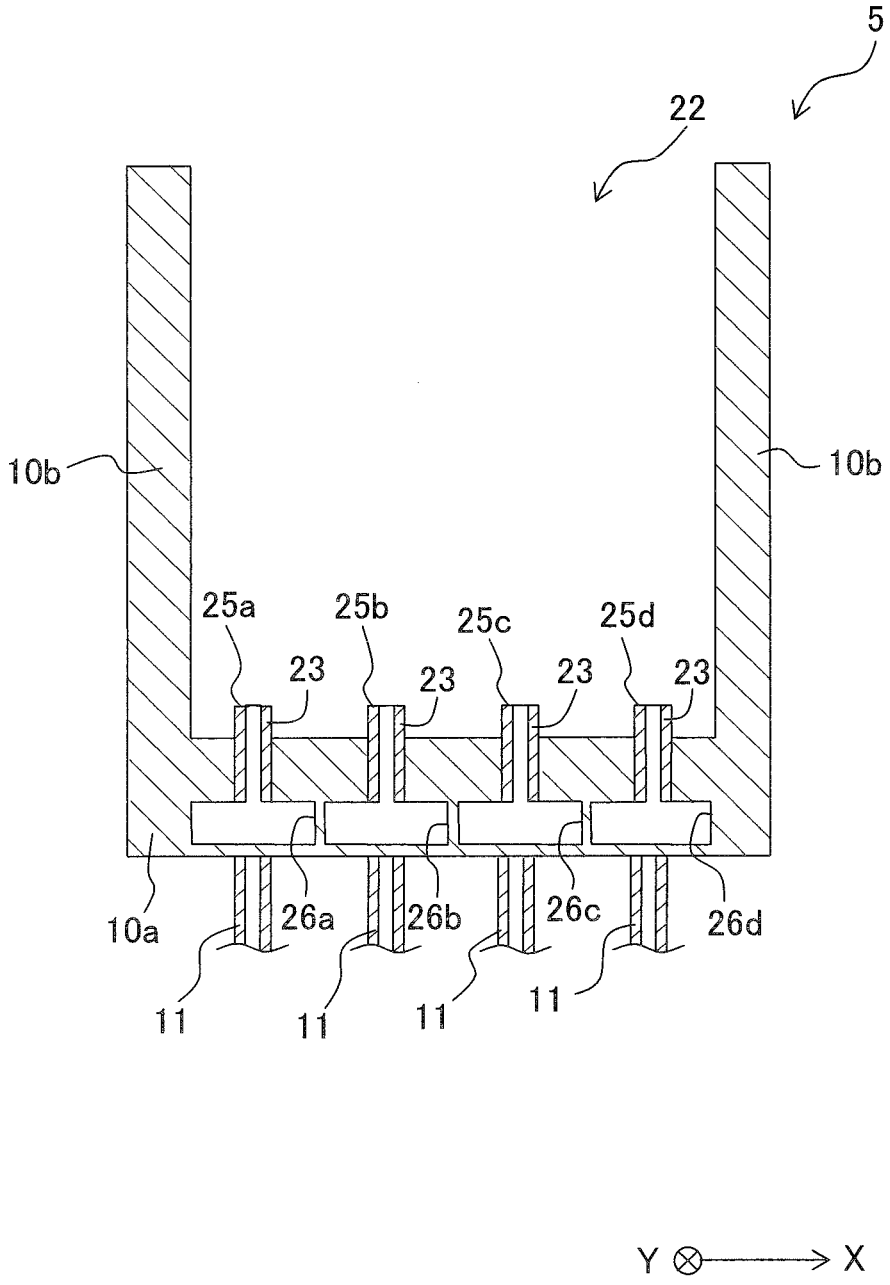
FIG. 4A shows a sectional view taken along a line IVA-IVA shown in FIG. 2.
Figure 4B:
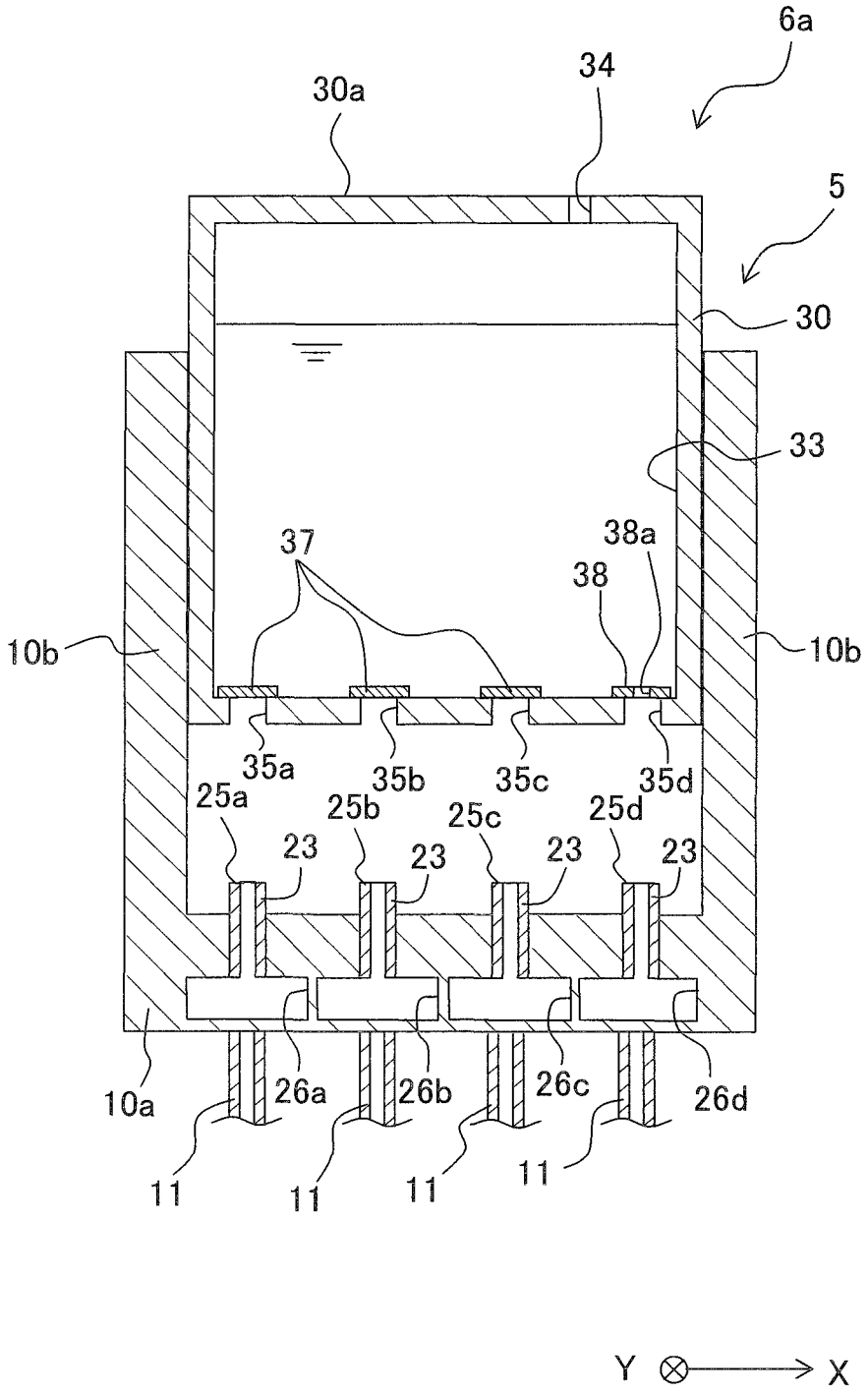
FIG. 4B shows a state in which an ink cartridge is inserted into a cartridge installing section.
Figure 5:
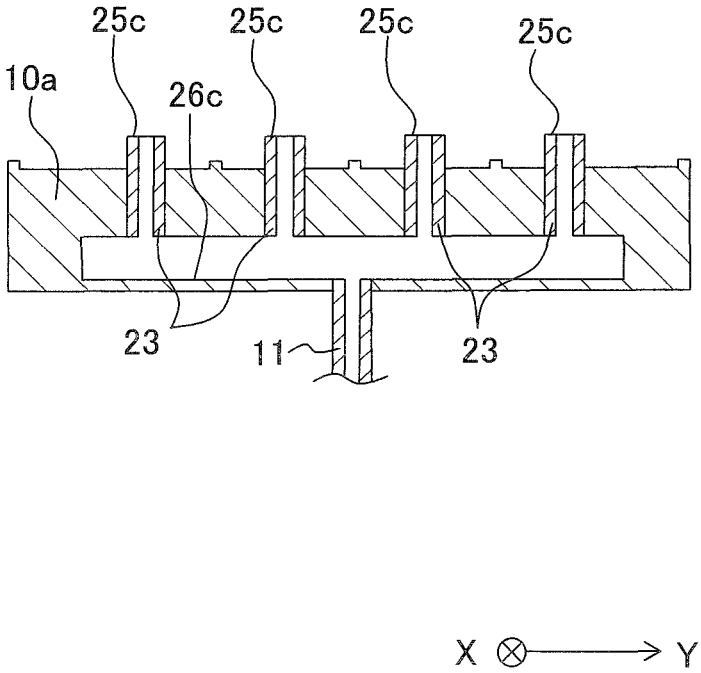
FIG. 5 shows a sectional view taken along a line V-V shown in FIG. 2.

In this way, in one cartridge installing section 22, a set of the connection ports 25*a* to 25*d* of the four different types is aligned in the X direction, and the four connection ports 25*a* to 25*d* included in the one set of the connection port are connected via the cylindrical members 23 to the four supply flow passages 26*a* to 26*d* respectively. The four connection ports 25 of the same type are aligned in the Y direction and are disposed at the same position in relation to the X direction among the different cartridge installing sections 22. These four connection ports 25 of the same type are connected to one of the supply flow passages 26 via the cylindrical members 23 on which the four connection ports 25 are formed respectively. Specifically, as shown in FIG. 5, the four connection ports 25*c*, which are aligned in the Y direction and which are disposed at the third positions as counted from the left as viewed in FIG. 2, are connected to the supply flow passage 26*c*, and they are connected to the corresponding tube 11. The other connection ports 25*a*, 25*b*, 25*d*, which are aligned in the Y direction, are also connected to the supply flow passages 26*a*, 26*b*, 26*d* respectively, and they are connected to the corresponding tubes 11. In this way, the four types of the connection ports 25*a* to 25*d*, which are arranged in the respective cartridge installing sections 22, are communicated with the four tubes 11 corresponding to the four color inks respectively.

Accordingly, the inks, each of which is supplied to one of the four connection ports 25*a* to 25*d* aligned in the X direction in one cartridge installing section 22, are allowed to flow to the four tubes 11 respectively via the four supply flow passages 26*a* to 26*d*.

Next, the ink cartridges 6 will be explained with reference to FIG. 6. The four ink cartridges 6, in which the four color inks are stored respectively, differ in only the positions of supply ports 38*a* as described later on, and they are constructed in the same manner in relation to the other features. Therefore, an explanation will be made about the arrangement or structure of one of the ink cartridges 6 in which the black ink is stored. An explanation will be made about only the difference in the supply ports 38*a* in relation to the arrangements or structures of the ink cartridges 6 in which the remaining three color inks are stored respectively.

Figure 6:
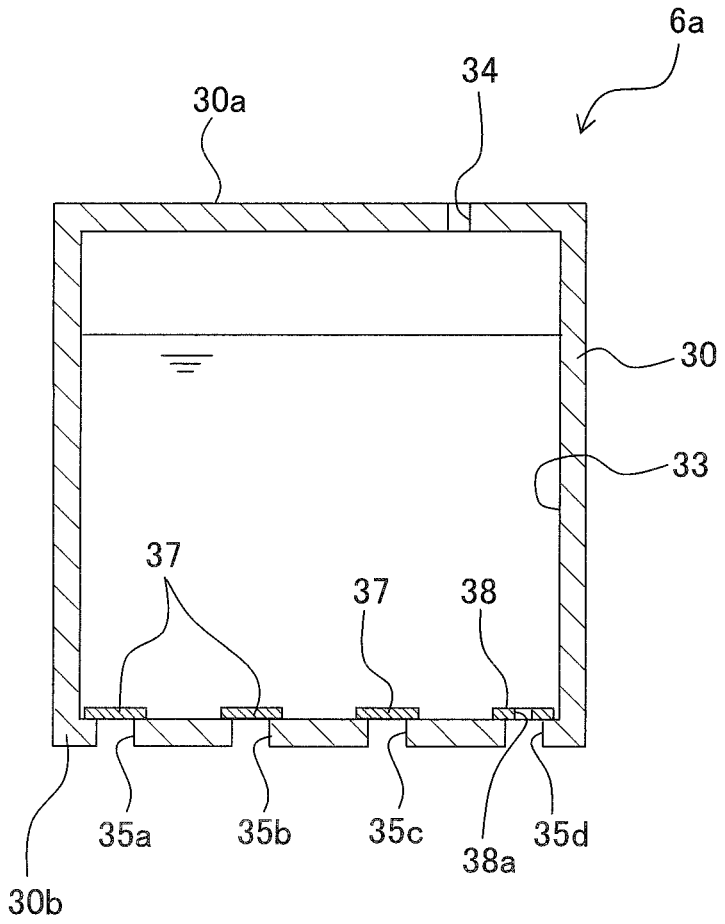
FIG. 6 shows a vertical sectional view illustrating the ink cartridge.
Figure 7A:
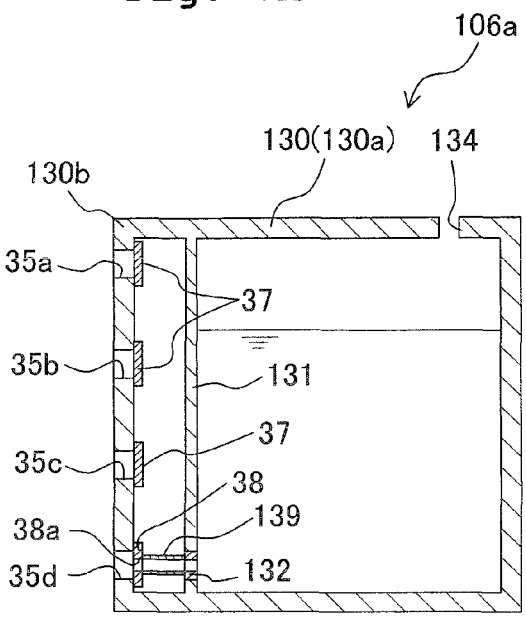
FIGS. 7A, 7B, 7C and 7D show vertical sectional views illustrating ink cartridges in a first modified embodiment, respectively.
Figure 7B:
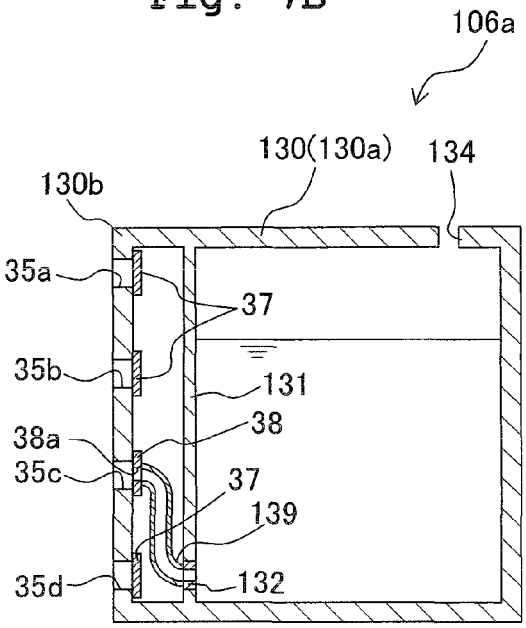
Figure 7C:
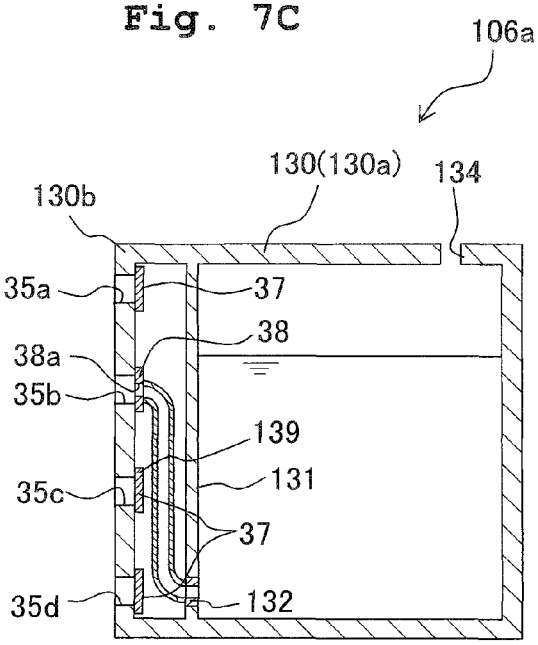
Figure 7D:
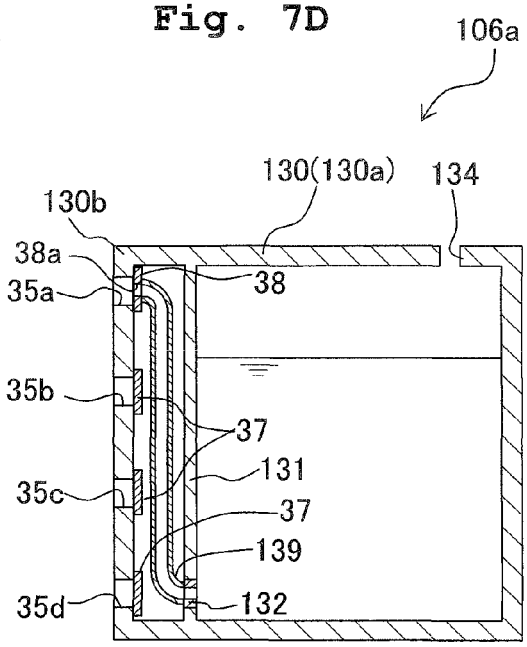

As shown in FIG. 6, the ink cartridge 6, in which the black ink is stored, has a rectangular parallelepiped-shaped cartridge body 30 in which an ink storage chamber 33 for storing the ink is formed. An atmospheric air communication hole 34 is formed through an upper wall 30*a* of the cartridge body 30. Four communication holes 35*a* to 35*d*, which are aligned in one direction and which correspond to the four connection ports 25*a* to 25*d* of the cartridge installing section 22 respectively, are formed through a bottom wall 30*b*. Rubber members 37, which are provided as seal members, are stuck to the three communication holes 35*a* to 35*c* from the side of the ink storage chamber 33. A rubber member 38, which is formed with a supply port 38*a*, is stuck to the one remaining communication hole 35*d* from the side of the ink storage chamber 33. The three communication holes 35*a* to 35*c* are sealed by the rubber members 37 so that the ink contained in the ink storage chamber 33 does not flow out. As for the one remaining communication hole 35*d*, the ink contained in the ink storage chamber 33 flows out from the supply port 38*a* of the rubber member 38 when the ink cartridge 6 is installed to the cartridge installing section 22. When the ink cartridge 6 is not installed to the cartridge installing section 22, the one remaining communication hole 35*d* is sealed by a sealing mechanism such as an unillustrated valve mechanism or the like so that the ink contained in the ink storage chamber 33 does not flow out. The structure of the valve mechanism is not specifically limited. However, it is possible to utilize, for example, a valve (check valve) which is openable in one direction.

Regarding the ink cartridges 6 in which the three remaining color inks other than the black are stored respectively, the position of the communication hole, which is included in the four communication holes 35*a* to 35*d* and to which the rubber member 38 is stuck, differs depending on the colors of the inks stored in the ink storage chambers 33. Further, the rubber members 37 are stuck to the three remaining communication holes other than the communication hole to which the rubber member 38 is stuck, of the four communication holes 35*a* to 35*d*. In this way, the positions, at which the inks flow out when the ink cartridges 6 are installed to the cartridge installing sections 22, are different while being deviated in one direction depending on the respective colors of the inks stored in the ink storage chambers 33, in relation to the ink cartridges 6 in which the four color inks are stored respectively.

When the ink cartridge 6 storing the black ink is installed to the cartridge installing section 22 while directing the supply port 38*a* downwardly in the vertical direction, the recesses of the ink cartridge 6, in which the rubber members 37, 38 and the inner circumferential surfaces of the four communication holes 35*a* to 35*d* aligned in one direction are arranged, are fitted to portions of the four cylindrical members 23 aligned in the X direction protruding from the bottom wall 10*a*.

The three connection ports 25*a* to 25*c* of the cartridge installing section 22 abut against the rubber members 37 stuck to the communication holes 35*a* to 35*c* of the ink cartridge 6, and the three connection ports 25*a* to 25*c* are sealed. The remaining connection port 25*d* of the cartridge installing section 22 abuts against the rubber member 38 stuck to the communication hole 35*d* of the ink cartridge 6. In this situation, the supply port 38*a* of the rubber member 38 is released from the sealing having been effected by the unillustrated sealing mechanism. The communication with the communication hole 35*d* is caused, and the ink contained in the ink storage chamber 33 flows out to the supply flow passage 26*d* via the connection port 25*d*. The black ink, which flows out to the supply flow passage 26*d*, is supplied to the subtank 4 via the corresponding tube 11.

This process also proceeds similarly or identically when the ink cartridges 6, in which the remaining three color inks other than the black are stored respectively, are installed to the cartridge installing sections 22. The rubber member 38 is stuck to only one of the communication holes 35*a* to 35*d*, corresponding to the color of the ink stored in the ink storage chamber 33. The one of the communication holes 35*a* to 35*d* is communicated with corresponding one of the connection ports 25*a* to 25*d*. The ink, which is contained in the ink storage chamber 33, flows out to one of the supply flow passages 26*a* to 26*d* via corresponding one of the connection ports 25*a* to 25*d*. The ink is supplied to the subtank 4 via the corresponding tube 11. In this way, the order of alignment of the plurality of connection ports 25*a* to 25*c* aligned in the X direction with respect to the ink cartridge 6 is identical among the cartridge installing sections 22.

As described above, the four connection ports 25*a* to 25*d*, which correspond to the four communication holes 35*a* to 35*d* respectively, are arranged in each of the cartridge installing sections 22 of the ink supply apparatus 5 of this embodiment. The inks, each of which is supplied from one of the four connection ports 25*a* to 25*d*, are supplied to the corresponding four subtanks 4 respectively via the tubes 11 and the supply flow passages 26*a* to 26*d* which are different from each other. The ink of the same color is supplied from the ink cartridge or ink cartridges 6 to the four connection ports 25*a* to 25*d* which have the same position in relation to the X direction and which are arranged in the respective cartridge installing sections 22 while being aligned in the Y direction. The ink, which is supplied from the four connection ports 25*a* to 25*d* aligned in the Y direction, is supplied to the corresponding subtank 4 via one of the supply flow passages 26*a* to 26*d* and the tube 11.

Therefore, the four ink cartridges 6, which store the four color inks respectively, can be installed at arbitrary positions without determining the positions of installation with respect to the four cartridge installing sections 22. Even when any one of the four ink cartridges 6 is installed at any position, then the supply port 38*a* of the ink cartridge 6 is communicated with one of the connection ports 25*a* to 25*d* corresponding to the type of the ink cartridge 6, and the ink can be supplied to the corresponding subtank 4 (ink-jet head 3) via one of the supply flow passages 26*a* to 26*d* connected to the one of the connection ports 25*a* to 25*d*. In this way, any installation position is available for the ink cartridge 6 without any problem, and the installation operation is conveniently performed by a user.

If the installable position of the cartridge installing section 22 is previously determined for every ink cartridge 6, it is necessary that any complicated artifice to avoid the erroneous installation should be provided for the ink cartridges 6 and the cartridge installing sections 22, in order to avoid the erroneous installation of the ink cartridges 6 to the cartridge installing sections 22. However, in the embodiment of the present teaching, any installation position is available for the ink cartridges 6 with respect to the cartridge installing sections 22 without any problem. Therefore, it is unnecessary to provide any artifice for the ink cartridges 6 and the cartridge installing sections 22 in order to avoid the erroneous installation. It is possible to simplify the arrangement or structure of the ink cartridges 6 and the cartridge installing sections 22.

Further, the four types of the connection ports 25*a* to 25*d*, which are aligned in the Y direction and to which the ink of the same color is supplied, are commonly connected to one of the supply flow passages 26*a* to 26*d*. Therefore, it is enough to provide the four tubes 11 (one tube 11 for each of the colors) which connect the four types of the supply flow passages 26*a* to 26*d* for the respective colors to the subtanks 4 (ink-jet head 3) provided as the connection objectives disposed on the downstream side of the ink supply respectively. In this way, one of the supply flow passages 26*a* to 26*d*, which is connected to the four connection ports 25*a* to 25*d* subjected to the supply of the ink of the same color, is formed as one flow passage. Accordingly, it is possible to simplify the arrangement or structure of the liquid supply section to supply the liquid to the subtank 4 (ink-jet head 3).

Further, the connection ports 25*a* to 25*d* are open upwardly in the vertical direction, and the supply port 38*a* is formed on the bottom surface of the ink cartridge 6. Therefore, the ink can be supplied downwardly in the vertical direction. The ink, which is contained in the ink cartridge 6, can be supplied to the end without allowing the ink to remain. In this arrangement, when any ink cartridge 6 of the four ink cartridges 6 installed to the four cartridge installing sections 22 respectively is exchanged, then the ink cartridge 6 to be exchanged is firstly detached from the cartridge installing section 22, and a new ink cartridge 6 is installed to the cartridge installing section 22. When the ink cartridge 6 is detached or installed, it is feared that the air may be mixed from the four connection ports 25*a* to 25*d* of the cartridge installing section 22. If the air is mixed from the connection ports 25*a* to 25*d*, it is feared that the air may flow to the supply flow passages 26*a* to 26*d* communicated with the connection ports 25*a* to 25*d*, and the flow passages may be clogged up.

In such a situation, the purge operation, in which the ink is forcibly jetted from the ink-jet head 3 to remove the air, can be also performed for the flow passage communicated with one of the connection ports 25*a* to 25*d* connected to the supply port 38*a* of the ink cartridge 6 subjected to the exchange. However, if the purge operation is also performed for the flow passages communicated with the remaining three of the connection ports 25*a* to 25*d*, then the purge operation is consequently performed for the flow passages corresponding to all of the inks every time when any one of the ink cartridges 6 is exchanged, and the ink consumption amount is increased. On the other hand, the air is hardly mixed from the connection ports 25*a* to 25*d*, for example, when the ink cartridge 6 is exchanged, because the connection ports 25*a* to 25*d* are open upwardly in the vertical direction. Further, even when the air is mixed, the air is moved upwardly in accordance with the buoyancy. Therefore, the air is suppressed from flowing to the supply flow passages 26*a* to 26*d*, and it is possible to avoid the clog up of the flow passages.

Next, modified embodiments, in which various modifications are applied to the embodiment described above, will be explained. However, the components or parts, which are constructed in the same manner as those of the embodiment described above, are designated by the same reference numerals, any explanation of which will be appropriately omitted.

First Modified Embodiment

In the embodiment of the present teaching, the connection ports 25*a* to 25*d* of the cartridge installing section 22 are open upwardly in the vertical direction. However, the direction, in which the connection ports 25*a* to 25*d* are open, may be arbitrary. However, the ink cartridges 6 are preferably constructed as follows depending on the direction in which the connection ports 25*a* to 25*d* are open. An explanation will be made with reference to FIG. 7 about the arrangement of the ink cartridges as exemplified by an exemplary case in which the connection ports 25*a* to 25*d* of the cartridge installing sections 22 are constructed in the same manner as those of the embodiment described above except that the connection ports 25*a* to 25*d* are open in the horizontal direction by way of example.

In this arrangement, as shown in FIGS. 7A to 7D, atmospheric air communication holes 134 are formed through upper walls 130*a* of cartridge bodies 130, and communication holes 35*a* to 35*d* are formed through side walls 130*b* thereof in the installing states of four ink cartridges 106*a* to 106*d* in which the inks of different colors are stored respectively. A rubber member 38 is stuck to one communication hole of the four communication holes 35*a* to 35*d* in the same manner as in the embodiment described above, and rubber members 37 are stuck to the remaining three communication holes. The communication holes, which are included in the communication holes 35*a* to 35*d* and to which the rubber members 38 are stuck, have the positions which differ depending on the respective colors of the inks. Further, the interior of each of the four ink cartridges 106*a* to 106*d* is divided or comparted into two spaces by a partition plate 131. The ink is stored in the space disposed on the side separated from the side wail 130*b* formed with each of the communication holes 35*a* to 35*d*. A through-hole 132 is formed at the lower end of the partition plate 131. The through-hole 132 and a supply port 38*a* of the rubber member 38 are connected by a tube 139. In this way, the ink, which is contained in the ink cartridge 106, is connected to the supply port 38*a* of the rubber member 38 via the tube 139 from the through-hole 132 disposed at the lower end of the partition plate 131. Therefore, even when the supply port 38*a* is disposed at any position in relation to the vertical direction of the ink cartridge 106, the ink contained in the ink cartridge 106 can be supplied to the end.

In this arrangement, when the ink cartridge 106 to be exchanged is detached from the cartridge installing section 22 when any ink cartridge 106 of the four ink cartridges 106 installed to the four cartridge installing sections 22 respectively is exchanged, it is feared that the air may tend to be mixed from the four connection ports 25*a* to 25*d* of the cartridge installing section 22 from which the ink cartridge 106 has been detached, and the flow passage clog up may be caused by the mixed air. In view of the above, it is preferable that the ink supply apparatus is constructed in accordance with a second modified embodiment or a third modified embodiment described below in order that the mixed air is not allowed to flow to the downstream flow passage or the mixed air is removed.

Second Modified Embodiment

Figure 8A:
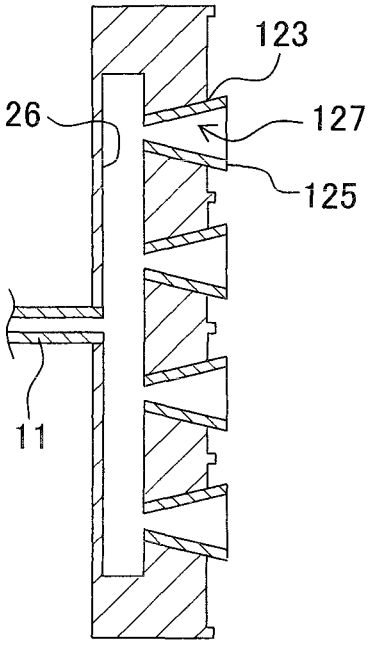
FIGS. 8A and 8B correspond to FIG. 5 in a second modified embodiment.
Figure 8B:
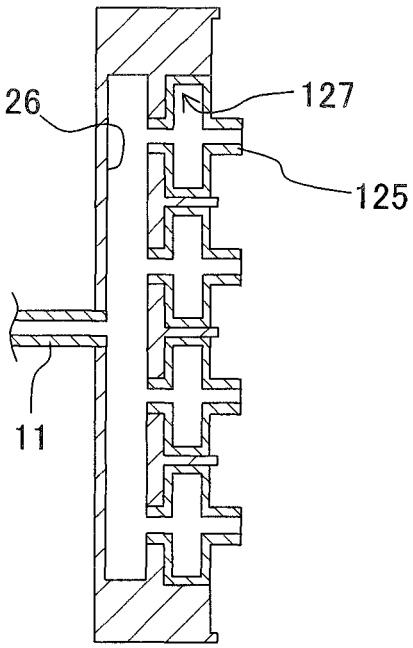

At first, an arrangement of the ink supply apparatus, which is provided in order to avoid the mixed air from flowing to the downstream flow passage, will be explained with reference to FIGS. 8A and 8B. As shown in FIG. 8A, in this modified embodiment, the cylindrical member 23 in the embodiment described above is replaced by a cylinder member 123 having diameters which are reduced at positions disposed nearer to the supply flow passage 26. The other features are the same as or equivalent to those of the embodiment described above. A connection port 125, which is connected to the supply port 38*a* of the ink cartridge or which is sealed by the rubber member 37, is formed at the forward end of the cylinder member 123. The space in the cylinder member 123, which is formed between the connection port 125 and the supply flow passage 26, is a capture space 127 for capturing the air. The portion, which is the outlet portion of the capture space 127 and which is connected to the supply flow passage 26, has a cross-sectional area which is smaller than a cross-sectional area of the capture space 127 in the direction perpendicular to the direction in which the ink flows. Accordingly, when the ink cartridge is exchanged, the air, which is mixed from the connection port 125 when the ink cartridge to be exchanged is detached from the cartridge installing section, is captured by the capture space 127 of the cylinder member 123. The flow resistance of the flow passage of the outlet portion of the capture space 127 is larger than the flow resistance of the flow passage in the capture space 127. Therefore, even when the air stays in each of the capture spaces 127 when a certain connection port 125 is communicated with the supply port 38*a* of the ink cartridge, and the flow arises in the ink contained in the supply flow passage 26, then the air hardly flows into the supply flow passage 26, because the flow resistance of the flow passage is large at the outlet portion of the capture space 127. In this way, the air is captured by the capture space 127 before the merging at the supply flow passage 26, and thus it is possible to avoid the flow passage clog up which would be otherwise caused by the air. As shown in FIG. 8B, the connection ports 125 may be constructed in the same manner as in the embodiment of the present teaching, and a capture space 127 may be formed between each of the connection ports 125 and the supply flow passage 26.

Third Modified Embodiment

Figure 9A:
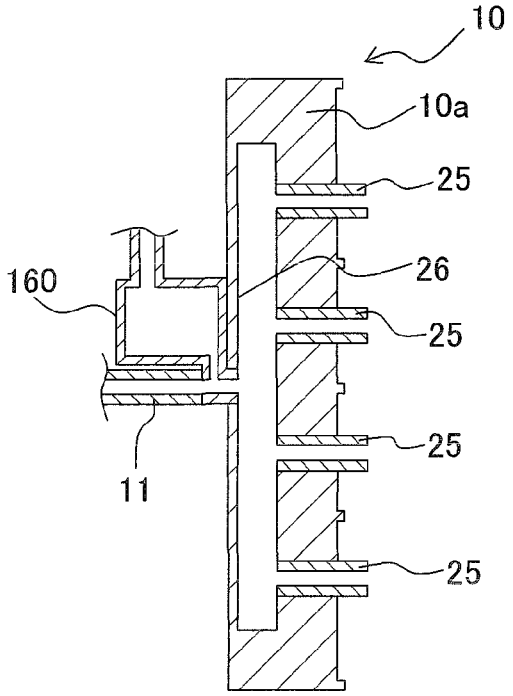
FIG. 9A shows an example of an air buffer of a third modified embodiment and FIG. 9B shows another example of the air buffer of the third modified embodiment.
Figure 9B:
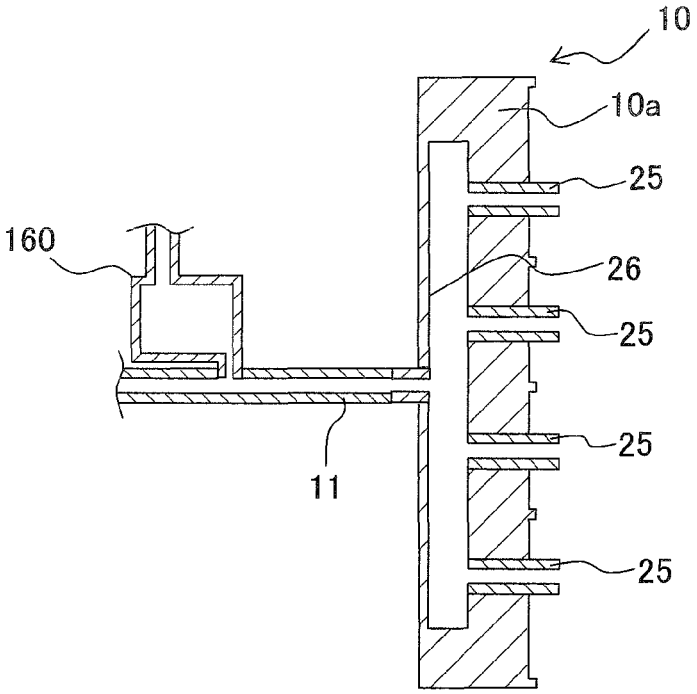

Next, an explanation will be made with reference to FIGS. 9A and 9B about an arrangement of the ink supply apparatus in order to remove the mixed air. In the third modified embodiment, as shown in FIG. 9A, the holder 10 is provided with an air buffer 160 formed at a connecting portion between the supply flow passage 26 and the tube 11. Alternatively, as shown in FIG. 9B, the air buffer 160 may be formed in the tube 11 at an arbitrary position. In these cases, one air buffer 160 may be formed for the supply flow passages 26/tubes 11 in common, or a plurality of air buffers 160 may be formed for the supply flow passages 26/tubes 11, respectively. The other features are the same as or equivalent to those of the embodiment described above. The air buffer 160 is branched upwardly from the connecting portion between the supply flow passage 26 and the tube 11. In this arrangement, the air buffer 160 is communicated at an upper portion thereof with the ink cartridge installed to the cartridge installing section. Accordingly, when the air is mixed after the merging at the supply flow passage 26, the air is captured by the air buffer 160 in accordance with the buoyancy before the air flows to the tube 11. The air, which is captured by the air buffer 160, is sucked together with the ink by means of an air removing mechanism such as an unillustrated pump or the like. The ink and the air, which have been sucked, are discharged to the ink cartridge installed to the cartridge installing section in order to recover the ink. In this way, the air is captured and removed by the air buffer 160 after the merging at the supply flow passage 26, and thus it is possible to avoid the flow passage clog up which would be otherwise caused by the air mixed into the subtank 4 (inkjet head 3). The air, which is captured by the air buffer 160, may be discharged to the atmospheric air by means of the air removing mechanism without discharging the air to the ink cartridge. The second and third modified embodiments are not limited to such a case that the direction, in which the connection port is open, is the horizontal direction as in the first modified embodiment. The second and third modified embodiments can be also applied to any case in which the connection port is open in any direction. In particular, in the second modified embodiment, the air in the flow passage, which is moved upwardly in accordance with the buoyancy, can be captured more efficiently, because the capture space 127 is disposed over or above the supply flow passage 26 when the connection port 125 is open upwardly.

In the embodiment of the present teaching, the supply flow passage 26 is formed in the bottom wall 10*a* of the holder 10 which constitutes the cartridge installing sections 22. However, the supply flow passage 26 may be composed of a tube or the like without being formed in the holder 10.

Further, in the embodiment of the present teaching, the four ink cartridges 6, in which the inks of the different colors are stored respectively, are installed to the four cartridge installing sections 22 respectively. However, the ink cartridges 6, which store the ink of the same color, may be installed to a plurality of the cartridge installing sections 22 respectively. For example, in the case of the monochrome printing or black and white printing, only the black ink is used. Therefore, the ink cartridges 6, in which the black ink is stored, may be installed to all of the cartridge installing sections 22. In this situation, even when the ink volumes (liquid surface heights) are different among the plurality of ink cartridges 6 upon the installation, an identical ink-surface height is provided in all of them since all of the ink cartridges 6 are communicated with each other via the supply flow passage 26. Therefore, only the ink, which is contained in one ink cartridge 6, is not excessively consumed, and the ink is consumed equivalently or uniformly.

The present teaching is not limited to the case in which the ink cartridges 6 stored with the black ink are installed to all of the cartridge installing sections 22. There may be the case in which only the cartridges 6 of one type, each of which is any one of those for yellow, cyan, and magenta, are installed to all of the cartridge installing sections 22. Further, the ink cartridges 6 of any two types of those for the four color inks may be installed to the cartridge installing sections 22, or the ink cartridges 6 of any three types may be installed thereto. Accordingly, a larger number of the ink cartridges 6 for storing the ink having a large consumption amount can be installed to the cartridge installing sections 22 as compared with the ink cartridge 6 for storing the ink having a small consumption amount. Therefore, it is possible to decrease the frequency of the exchange of the ink cartridge 6. On the other hand, for example, subcartridges, which store the inks of a plurality of kinds, may be formed for one ink cartridge. For example, three subcartridges, which store the three color inks of cyan, magenta, and yellow respectively, may be formed in one ink cartridge. In this case, when the ink cartridge having three subcartridges is installed to the cartridge installing section, the three color inks are supplied to the three connection ports of the cartridge installing section. In the case of the printer having the four cartridge installing sections as described above, when the ink cartridges for the black ink are installed to the three ink cartridge installing sections, and the ink cartridge for the three color inks, in which three subcartridges for the three color inks of cyan, magenta, and yellow are formed integrally, is installed to the remaining cartridge installing section, then a large amount of the black ink which is consumed heavily can be supplied, and it is also possible to perform the color printing.

Fourth Modified Embodiment

Figure 10:
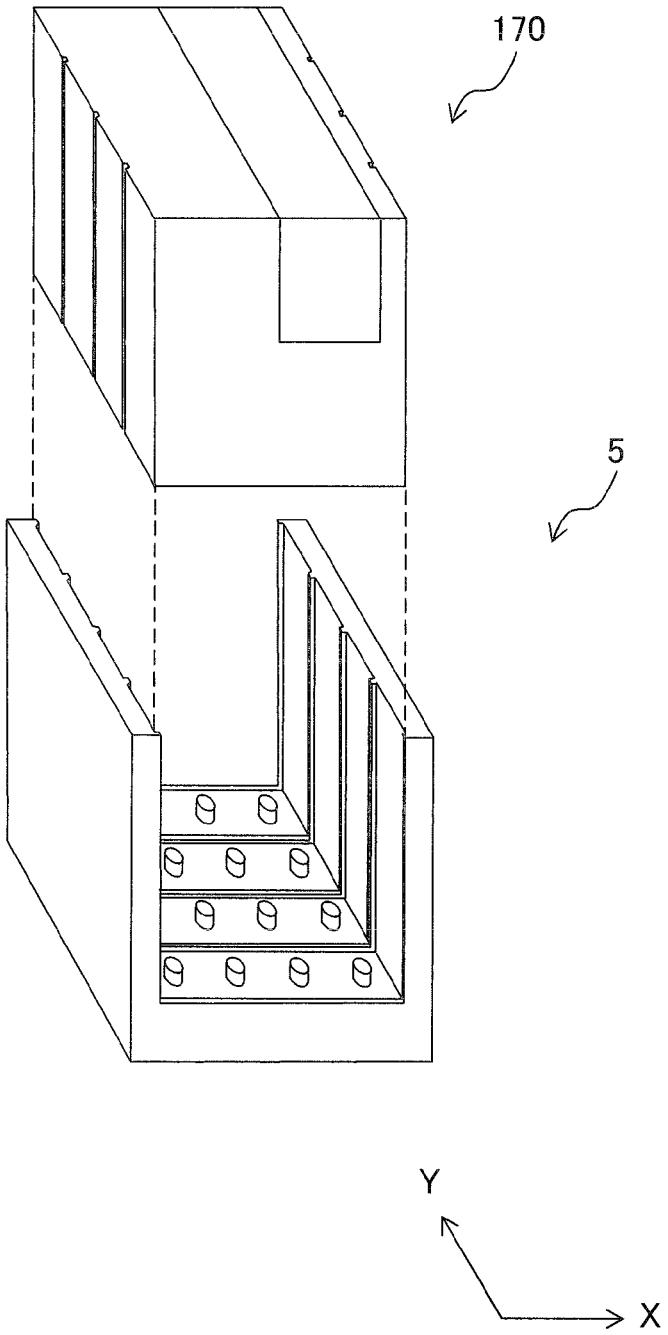
FIG. 10 corresponds to FIG. 2 in a fourth modified embodiment.

Additionally, as shown in FIG. 10, an ink cartridge 170 having a large volume can be also installed to the ink supply apparatus 5 of the embodiment of the present teaching instead of the ink cartridges 6 for a plurality of colors. In this case, the number of the supply port or supply ports of the ink cartridge 170 may be either one or a number corresponding to the number of the cartridge installing sections 22.

In the embodiment of the present teaching, the cartridge installing section 22 has the four connection ports 25*a* to 25*d* corresponding to the four ink cartridges 6 for storing the four color inks. However, the number of the connection port or connection ports may be a number corresponding to the number of the ink cartridge or ink cartridges having the different types, which may be an arbitrary number.

Figure 11:
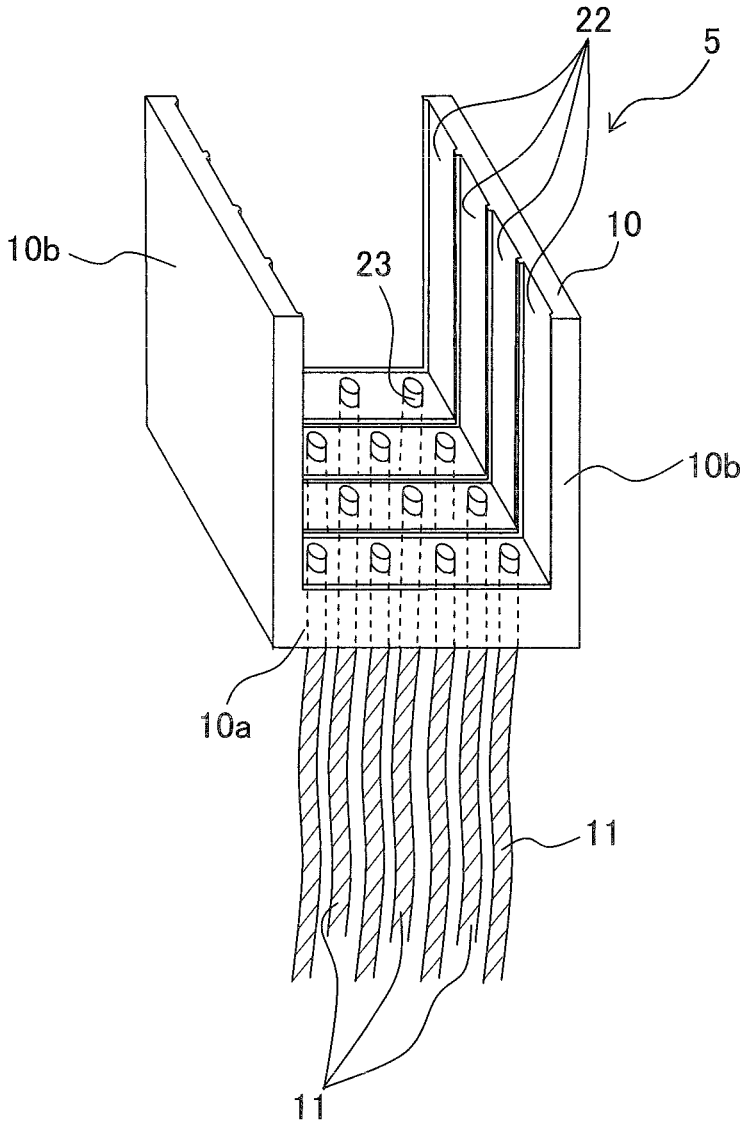
FIG. 11 shows an example in which respective supply flow passages are formed independently.

In the embodiment of the present teaching, the connection ports 25 of the cartridge installing sections 22, to which the ink of the same color is supplied, are merged into one at the supply flow passage 26, and they are connected to one of the subtanks 4 via one tube 11. Therefore, the number of the connecting portions (the number of the tubes 11) to be connected to the subtanks 4 corresponds to the number of the ink cartridges having the different types to be installed to the cartridge installing sections 22. However, the present teaching is not limited thereto. It is appropriate that the connection is made between each of the subtanks and each of the ink cartridges by means of at least one connecting portion (tube or the like). For example, as shown in FIG. 11, the supply flow passages, which are connected to the plurality of connection ports 25 respectively, may be connected to the subtanks 4 via a plurality of tubes 11 (for example, sixteen tubes 11 in this embodiment) independently respectively without being communicated with each other. In the embodiment of the present teaching, the supply flow passages 26 are formed in the holder 10 for the cartridge installing sections 22. However, as shown in FIG. 11, it is not necessarily indispensable that the respective supply flow passages should be formed integrally with the holder. For example, the respective supply flow passages may be formed with tubes respectively.

Figure 12:
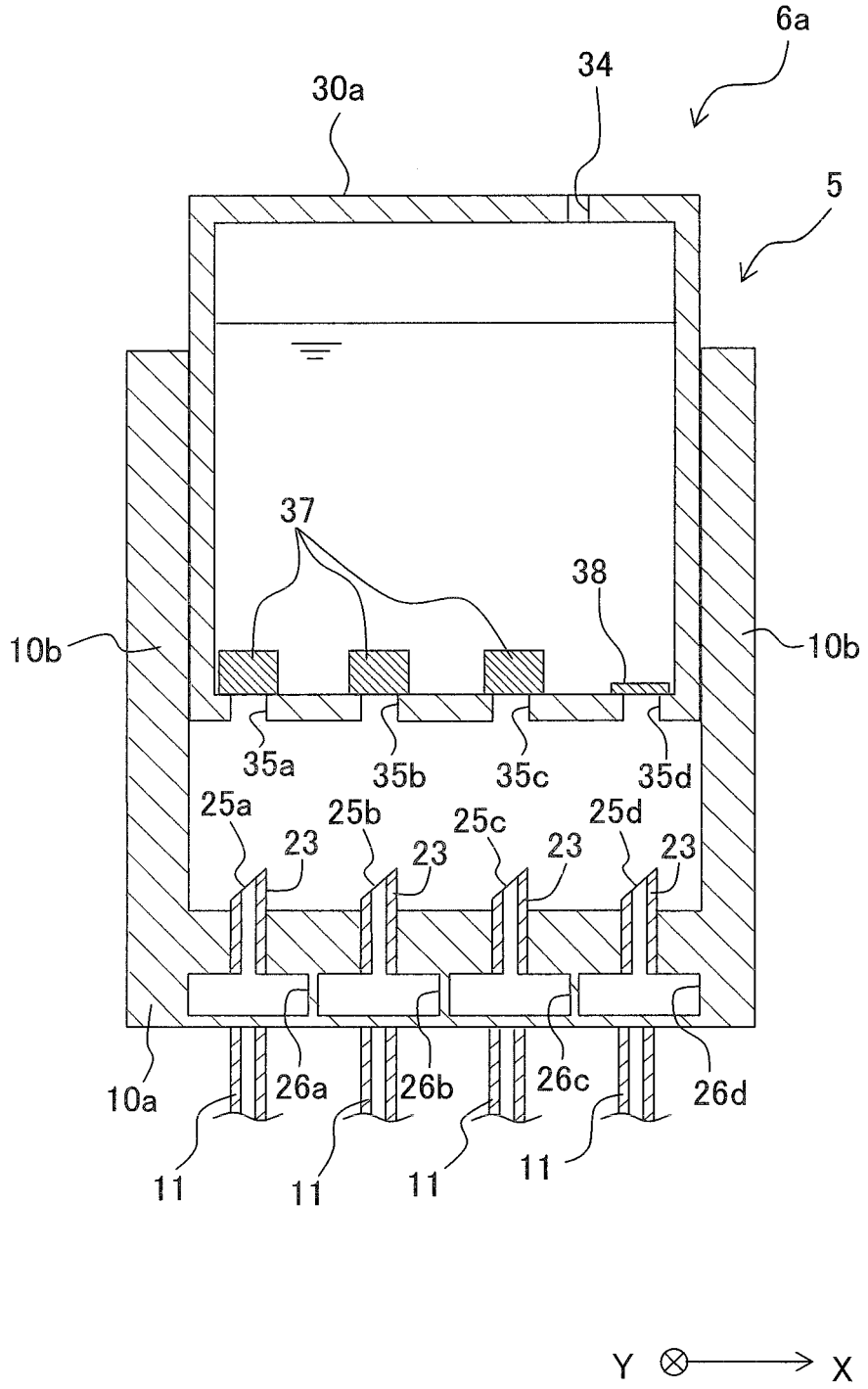
FIG. 12 shows an example in which the cylindrical members are the hollow needles.

In the embodiment of the present teaching, the supply port 38*a* of the ink cartridge 6 is formed for the rubber member 38. However, there is no limitation thereto. It is also allowable that the rubber member 38 is not formed with the supply port 38*a*. In this case, for example, as shown in FIG. 12, the following arrangement is also available. That is, the cylindrical members 23 of the cartridge installing section 22 are hollow needles, and the rubber members 37 of the ink cartridge 6 have a thickness thicker than a thickness of the rubber member 38, wherein the cylindrical member 23 (hollow needle) is long enough to penetrate through the rubber member 38, but the cylindrical members 23 (hollow needles) is not long enough to penetrate through the rubber members 37. Specifically, the communication hole 35, which corresponds to the stored ink, is sealed with the rubber member 38, and the other communication holes 35 are sealed with the rubber members 37 having the thickness thicker than the thickness of the rubber member 38. When the ink cartridge 6 is installed to the cartridge installing section 22, then the cylindrical member 23 (hollow needle), which corresponds to the rubber member 38, penetrates through the rubber member 38, and the ink storage chamber 33 and the supply flow passage 26 are communicated with each other. On the other hand, the rubber members 37 are thicker than the rubber member 38, and the cylindrical members 23 (hollow needles) can not penetrate through the rubber members 37. Therefore, the rubber members 37 still seal the communication holes 35. According to this arrangement, it is unnecessary to seal the supply port 38*a*, because the ink cartridge 6 is not formed with the supply port 38*a*. Further, the connection port 25 is formed at the forward end of the hollow needle having the thin or small diameter. Therefore, when the ink cartridge 6 is detached from the cartridge installing section 22, the ink does not flow out from the connection port 25. In the embodiment and the modified embodiments thereof, the connection ports, which are formed on the cartridge installing section, are open when the ink cartridge is not installed to the cartridge installing section. When the ink cartridge is installed to the cartridge installing section, the connection ports are sealed except for one. However, the present teaching is not limited thereto. All of the connection ports may be sealed when the ink cartridge is not installed to the cartridge installing section, while one of the connection ports may be communicated with the ink cartridge when the ink cartridge is installed to the cartridge installing section.

In the embodiment and the modified embodiments thereof explained above, the present teaching is applied to the ink supply apparatus 5 for supplying the ink or inks to the ink-jet head of the printer. However, the objective, to which the present teaching is applicable, is not limited to the printer as described above. The present teaching is applicable to any liquid supply apparatus for supplying the liquid or liquids to any apparatus disposed on the downstream side to be used in a variety of technical fields.

What is claimed is:

1. A liquid supply apparatus comprising:

a first cartridge comprising a first one of a single type of a cartridge body; and a second cartridge comprising a second one of the single type of the cartridge body, wherein the single type of the cartridge body comprises:

an inner surface defining a single storage chamber in which a first liquid of the first cartridge or a second liquid of the second cartridge is stored, an outer surface, and N number of communication holes, where N is an integer greater than one, wherein each of the N number of communication holes communicates the inner surface and the outer surface, and is configured to guide a flow of the first liquid or the second liquid out of the single storage chamber, and wherein a first communication hole of the N number of communication holes is designated as a first liquid supply hole, and a second communication hole of the N number of communication holes is designated as a second liquid supply hole, wherein the first liquid supply hole is different from the second liquid supply hole, wherein the first cartridge further comprises N−1 number of seal members, wherein each of the N−1 number of the seal members of the first cartridge is applied to the inner surface of the cartridge body of the first cartridge to seal a corresponding one of the N number of communication holes of the cartridge body of the first cartridge except the first liquid supply hole, and wherein the second cartridge further comprises N−1 number of seal members, wherein each of the N−1 number of the seal members of the second cartridge is applied to the inner surface of the cartridge body of the second cartridge to seal a corresponding one of the N number of communication holes of the cartridge body of the second cartridge except the second liquid supply hole, wherein the liquid supply apparatus further comprises:

a first cartridge installing section comprising N number of protruding members, wherein the N number of protruding members of the first cartridge installing section are configured to be insertable into the N number of communication holes of the cartridge body of the first cartridge, respectively, wherein each of the N number of protruding members of the first cartridge installing section defines a connection port that is configured to mate with a corresponding one of the N number of communication holes of the cartridge body of the first cartridge in a case that the N number of protruding members of the first cartridge installing section are inserted into the N number of communication holes of the cartridge body of the first cartridge, wherein the connection port of the protruding member mating with the first liquid supply hole of the cartridge body of the first cartridge is configured to further guide the flow of the first liquid flown from the single storage chamber of the cartridge body of the first cartridge, and wherein the connection ports of the remaining protruding members are configured to abut against the N−1 number of seal members of the first cartridge in a case that the N number of protruding members of the first cartridge installing section are inserted into the N number of communication holes of the cartridge body of the first cartridge, and a second cartridge installing section comprising N number of protruding members, wherein the N number of protruding members of the second cartridge installing section are configured to be insertable into the N number of communication holes of the cartridge body of the second cartridge, respectively, wherein each of the N number of protruding members of the second cartridge installing section defines a connection port that is configured to mate with a corresponding one of the N number of communication holes of the cartridge body of the second cartridge in a case that the N number of protruding members of the second cartridge installing section are inserted into the N number of communication holes of the cartridge body of the second cartridge, wherein the connection port of the protruding member mating with the second liquid supply hole of the cartridge body of the second cartridge is configured to further guide the flow of the second liquid flown from the single storage chamber of the cartridge body of the second cartridge, and wherein the connection ports of the remaining protruding members abut against the N−1 number of seal members of the second cartridge in a case that the N number of protruding members of the second cartridge installing section are inserted into the N number of communication holes of the cartridge body of the second cartridge.

2. The liquid supply apparatus according to claim 1, further comprising a plurality of supply flow passages which are connected to the connection ports.

3. The liquid supply apparatus according to claim 2, wherein a group of the supply flow passages, which are connected to the connection ports of the cartridge installing sections corresponding to a same type of the liquid cartridges, are communicated with each other.

4. The liquid supply apparatus according to claim 3, wherein the cartridge installing sections are aligned in one direction; and the connection ports of the respective cartridge installing sections are aligned in a perpendicular direction perpendicular to the one direction.

5. The liquid supply apparatus according to claim 3, wherein a capture space in which air is captured is formed at upstream portion of each of the supply flow passages, the upstream portion being located upstream from the supply flow passages to be commonly communicated, and a cross-sectional area of an outlet portion of the capture space through which the capture space is communicated with the commonly communicated supply flow passages is smaller than a cross-sectional area of the capture space.

6. The liquid supply apparatus according to claim 2, wherein each of the supply flow passages is provided with a first portion which has a first diameter and a second portion which is located in the middle of the first portion and which has a second diameter greater than the first diameter.

7. The liquid supply apparatus according to claim 2, wherein the plurality of cartridge installing sections have a holder which is formed with the connection ports and the plurality of supply flow passages;

the supply flow passages form a plurality of common flow passage groups, each of the common flow passage groups including the supply flow passages connected to the connection ports corresponding to a same type of the liquid cartridges respectively; and the holder is formed with a plurality of communication passages each of which communicate common flow passages included in the respective common flow passage groups with each other.

8. The liquid supply apparatus according to claim 7, wherein the liquid supply apparatus further comprises a plurality of tubes each of which is connected to the communication passages.

9. The liquid supply apparatus according to claim 8, wherein an air buffer, in which a space for capturing the air is defined, is connected to one of the tubes.

10. The liquid supply apparatus according to claim 7, wherein an air buffer, in which a space for capturing the air is defined, is connected to one of the communication passages of the holder.

11. The liquid supply apparatus according to claim 1, wherein the plurality of connection ports are open upwardly in a vertical direction.

12. The liquid supply apparatus according to claim 1, wherein the plurality of connection ports are open in a horizontal direction.

13. A printer for performing printing on a medium, the printer comprising:

the liquid supply apparatus according to claim 1, a head configured to perform the printing by discharging liquid droplets of the first liquid and the second liquid onto the medium;

a moving section configured to move the medium relative to the head; and supply flow passages configured to liquid-communicate the first cartridge installing section and the second cartridge installing section with the head are liquid-communicated, and through which the first liquid and the second liquid are supplied to the head.

* * * * *